US007398817B2

(12) United States Patent
Capotosti et al.

(10) Patent No.: US 7,398,817 B2
(45) Date of Patent: Jul. 15, 2008

(54) APPARATUS FOR CONFINING THE IMPURITIES OF A MOLTEN METAL CONTAINED INTO A CONTINUOUS CASTING MOULD

(75) Inventors: Romeo Capotosti, Terni (IT); Riccardo Tonelli, Rome (IT); Franco Macci, Rome (IT)

(73) Assignees: Thyssenkrupp Acciai Speciali Terni S.p.A, Terni (IT); Thyssenkrupp Nirosta GmbH, Krefeld (DE)

( * ) Notice: Subject to any disclaimer, the term of this patent is extended or adjusted under 35 U.S.C. 154(b) by 0 days.

(21) Appl. No.: 10/577,646

(22) PCT Filed: Oct. 31, 2003

(86) PCT No.: PCT/IT03/00708

§ 371 (c)(1),
(2), (4) Date: Dec. 18, 2006

(87) PCT Pub. No.: WO2005/042184

PCT Pub. Date: May 12, 2005

(65) Prior Publication Data

US 2007/0221357 A1 Sep. 27, 2007

(51) Int. Cl.
*B22D 11/06* (2006.01)

(52) U.S. Cl. ..... 164/428; 164/480

(58) Field of Classification Search ..... 164/428, 164/480

See application file for complete search history.

(56) References Cited

U.S. PATENT DOCUMENTS 5,857,514 A * 1/1999 Shook et al. ..... 164/480
7,243,702 B2 * 7/2007 Izu et al. ..... 164/480

FOREIGN PATENT DOCUMENTS

JP 7-16771 * 3/1995

* cited by examiner

*Primary Examiner*—Kuang Lin
(74) *Attorney, Agent, or Firm*—Browdy and Neimark

(57) ABSTRACT

A twin roll caster for an apparatus for confining the impurities in a molten metal fed by means of a discharger and contained into an area of a strip continuous casting mold delimited by the side surfaces of two casting rolls with counter-rotating horizontal axis and by two containment side plates positioned in contact with the rolls' bases is provided. The apparatus includes a discharger having at least two first series of holes for the molten metal supply, each series being formed by at least a pair of holes respectively directed towards one of the opposed side surfaces of the two rolls and at least a second pair of holes for the molten metal supply, each hole of such second pair being directed towards the side plate nearest thereto, and said at least one second pair of holes being positioned at a greater depth with respect to said two first series of holes, and at least two pairs of barriers present in one part of the area comprised between the end of the nozzle and the containment side plates, forming the cross-sections of said barriers therebetween, lying on a same horizontal plane, an Y angle.

21 Claims, 1 Drawing Sheet

Figure 1A:
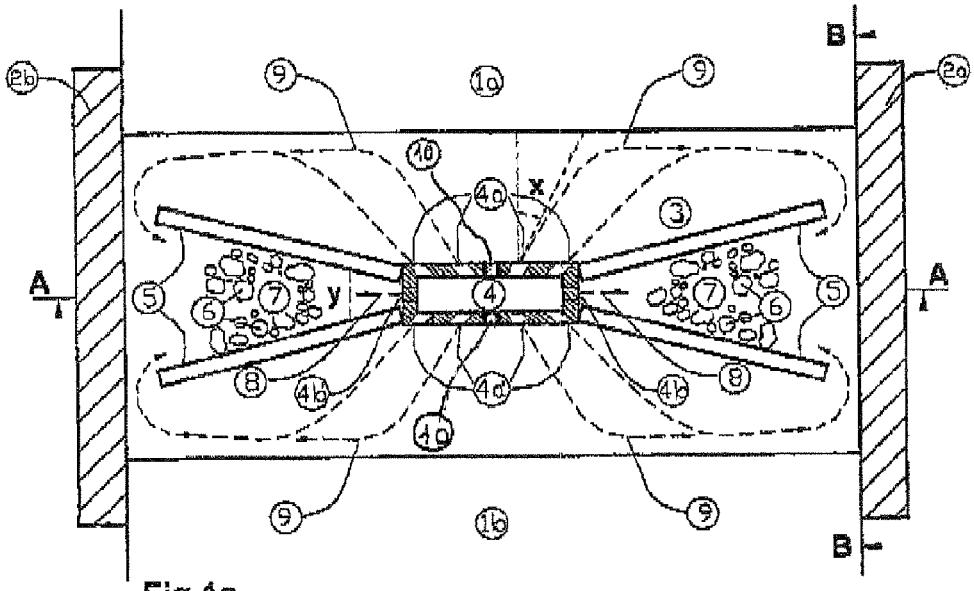

APPARATUS FOR CONFINING THE IMPURITIES OF A MOLTEN METAL CONTAINED INTO A CONTINUOUS CASTING MOULD

FIELD

The present invention relates to the field of the systems for feeding steel and confining impurities in strip continuous casting moulds.

BACKGROUND

As it is known, in the strip continuous casting with machine equipped with counter-rotating rolls, one of the main problems is constituted by the presence of impurities in the steel, which are typically constituted by oxides (coming from refining, transfer or casting of the molten metal) and by particles of refractory material (coming from the commonly utilized devices), which tend to float up and to conglomerate on the surface of the molten metal bath causing thickenings which can reach even a few squared-centimetre-wide area. Such impurities (commonly known under the term "scum") come then into contact with the surface of the rotating rolls and are dragged therefrom, then solidifying on the surface of the strip which is going to solidify and thus creating defects on the surface of the strip itself.

From the state of the art some devices are known to avoid the arising of this problem: both trying to limitate the metal oxidation, for example by protecting the liquid bath in the mould with inert gas, and by producing an extremely clean molten metal. Nevertheless, in practice it is not possible, at least in an industrial process, avoiding an even minimum oxidation of the steel during the treatment or the transfer for example from the ladle to the tundish. Other polluting sources, as already said, are constituted by the refractory materials used, such as the tundish coating, the stopper rod or the discharger feeding the metal into the mould or the metal covering powders in the tundish.

For this reason systems have been developed, which usually utilize barriers dipped into the molten metal in the mould parallely to the rolls' axis, which tend to the mould in parallelin parallel to the rolls' axis which tend to avoid the accumulation of these impurities near the surface of the casting rolls.

In particular, JP 6-106304 and JP 2001-321897 provide a pair of long barriers, arranged in parallelin parallel to the rolls' axis, dipped into the molten metal and a molten metal supply by means of a submersed discharger (hereinafter also designated as plunger) with holes directed towards the rolls' surface. A part of the molten metal flow strikes against the barriers, which are positioned between plunger and rolls, and it is reflected inwards, whereas a part thereof passes under the barriers and creates a flow parallel to the rolls' surface which drag the floating impurities confining them inside the compartment constituted by the barriers.

With this solution the floating impurities are not wholly moved away from the rolls' surface and in particular accumulations can form near the rolls in the bath area near the mould corners. This because the fluid flow directed towards the rolls is quite weak and not much effective since it is partially shielded by the barriers themselves and the holes are not directed so as to favour the movement of the impurities towards the mould corners. Furthermore, the superficial flow induced by the fluid part reflected by the barriers and directed towards the side plates, near the mould corners contrasts with the other superficial flow parallel to the rolls, hindering an easy accumulation of the impurities inside the barriers and creating stagnation areas between the barriers and the rolls where the impurities can thicken and where even steel solidifications may form with consequent defects on the cast strip surface.

Another drawback of this solution is that limited variations (already in the order of millimetres) in the positioning of the barriers or the holes of the nozzle cause significant variations in the metal flow which is rejected by the barriers and in that which passes thereunder and this significantly changes the fluiddynamic behaviour induced by the system. In an industrial iron-metallurgic context this constitutes a serious problem because, due to the dimensional tolerances, to the assembly techniques commonly used for the refractory components, to the unavoidable thermal expansions and to wears of the existing components, it is practically impossible to assure such a precision during the strip casting process.

Furthermore, the device disclosed in JP 6-106304 does not provide that at least a part of the molten metal supplied by the plunger be directly directed towards the side plates and this generally involves the formation of undesired solidifications on the plates themselves, with consequent serious casting problems.

The device disclosed in JP 2001-321897 utilizes a molten metal supply partially directed towards the side plates so that the discharger holes directed towards the side plates have a total area ranging between 0.3 and 0.7 of the total area of the other holes directed towards the surface of the casting rolls. On one side, if this solution avoids the formation of undesired solidifications on the side plates, on the other side it causes a fluid flow directed towards the plates which worsens the critical situation already described by opposing itself too to the superficial flow running parallel to the rolls' surface and it hinders an easy accumulation of the impurities inside the barriers.

U.S. Pat. No. 5,385,199 discloses the use of two barriers dipped into the molten metal bath parallel to the surface of the casting rolls at a distance from such surface ranging from 3 to 10 mm. In this case the purpose is to avoid the thickening of impurities on the bath surface near to the rolls by exploiting the turbulent motion which arises in the limited space between barrier and roll due to the revolving motion of the rolls themselves. However, with this solution steel solidifications can easily form on the bath between barriers and rolls. These solidifications impair the regular strip solidification causing unacceptable defects on the strip surface such as cracks and depressions.

Therefore, in the specific field there is the need of having at disposal an apparatus which to overcome the drawbacks inherent in the state of art.

This need is fulfilled by the present invention which furthermore has other advantages which will be evident as illustrated hereinafter.

SUMMARY

A twin roll caster comprising an apparatus for confining the impurities of a molten metal fed by means of a discharger and contained by into an area (3) of a strip continuous casting mould delimited by the side surfaces of two counter-rotating casting rolls with horizontal axis (1*a*, 1*b*) and by two containment side plates (2*a*, 2*b*) positioned in contact wiht the rolls' basesis provided. The apparatus includes:

a discharger (4) having at least two series of holes (4*a*, 4*a*') for the molten metal supply, each series being formed by at least a pair of holes directed towards one of the opposed side surfaces of the two rolls (1*a*, 1*b*), respectively, and at least a second pair of holes (4*b*, 4*b*') for the molten metal supply, each hole of such second pair being directed towards the side plate nearest thereto, and said at least one second pair of hole (4*b*, 4*b*') being positioned at a greater depth with respect to said two first series of holes (4*a*, 4*a*'); and at least two pairs of barriers (5) present in a part of the area (3) comprised between the plunger end and the containment side plates (2*a*, 2*b*), said at least two pairs of barriers forming a Y-shaped angle between the cross-section of said barriers, lying on a same horizontal plane,.

The holes of the first series of holes (4*a*, 4*a*') of the discharger (4) can be positioned symmetrically with respect to the plunger centre and slanted on the horizontal plane by an X angle of at least 5° with respect to the perpendicular to the rolls' axis, so that each hole of each pair be directed in a divergent way towards the side plate nearest thereto.

The holes of the first series of holes (4*a*, 4*a*') of the discharger (4) can be slanted on the horizontal plane by an X angle optionally different for each pair of holes.

The second pair of holes (4*b*, 4*b*') of the discharger (4) can be positioned at a depth greater by at least 5 mm with respect to any hole of the first two series of holes (4*a*, 4*a*').

The holes of said second pair of holes (4*b*, 4*b*') of the discharger (4) can be slanted inwards by an angle ranging between 0° and 30°.

The first series of holes (4*a*, 4*a*') of the discharger (4) can have the holes slanted upwards by an angle comprised between 0° and 45°.

The holes of the first series of holes (4*a*, 4*a*') of the discharger (4) can have a round-shaped cross-section with diameter comprised between 5 and 20 mm.

The holes of the first series of holes (4*a*, 4*a*') of the discharger (4) can have a polygonally-shaped cross-section.

The holes of the first series of holes (4*a*, 4*a*') of the discharger (4) can have a partially round-shaped and partially polygonally-shaped section.

The polygonal holes of the first series of holes (4*a*, 4*a*') of the discharger (4) can have a cross-section having a height lower than 20 mm.

The ratio between the total area of said second pair of holes (4*b*, 4*b*') and the total area of said first series of holes (4*a*, 4*a*') can be comprised between 0.15 and 0.30.

The discharger (4) in the centre can have at least an additional hole (10) directed perpendicularly to the side surface of the rolls, positioned between said first series of holes (4*a*, 4*a*') of the discharger (4).

The Y angle can be comprised between 5° and 45°.

The barriers (5) can be constituted by one or more parts of refractory or ceramic material containing compounds selected from the group comprising $Al_2O_3$, BN, $ZrO_2$, SiC, SiN, $SiO_2$, MgO and combinations thereof.

The barriers (5) can be slanted with respect to the vertical.

The barriers (5) can be reversibly fastened to a lid positioned in the mould above the molten metal bath or they can be integrating part of the lid itself, alternatively the barriers (5) can be fastened to the discharger (4) or they can be part of the discharger itself.

The barriers (5) can be formed by jets of inert or reducing gas, directed from the top towards the molten metal surface, which before being blown onto the molten metal surface is preheated at a temperature greater than 100° C.

It is also a subject of the present invention the use of the apparatus for confining impurities of a molten metal contained into a strip continuous casting mould wherein the barriers (5) are positioned at least 10 mm away from the side surface of the rolls, at least 20 mm away from the side plates (2*a*, 2*b*) and not less than 10 mm away from the discharger, and the use wherein the barriers (5) are partially dipped into the molten metal for at least 5 mm.

BRIEF DISCRIPTION OF THE DRAWINGS

A description of the present invention of general character has been given hitherto. With the help of the appended figures and of the example a more detailed description of the invention will be now provided with reference to an embodiment aimed at letting better know the objects, the features, the advantages and the operating modes thereof.

FIG. 1*a* is a schematic overhead sectional view of the roll mould and of the apparatus subject of the present invention taken on a horizontal plane passing through the axis of the holes directed towards the rolls' surface, all shown here at the same height for sake of simplicity.

Figure 1B:
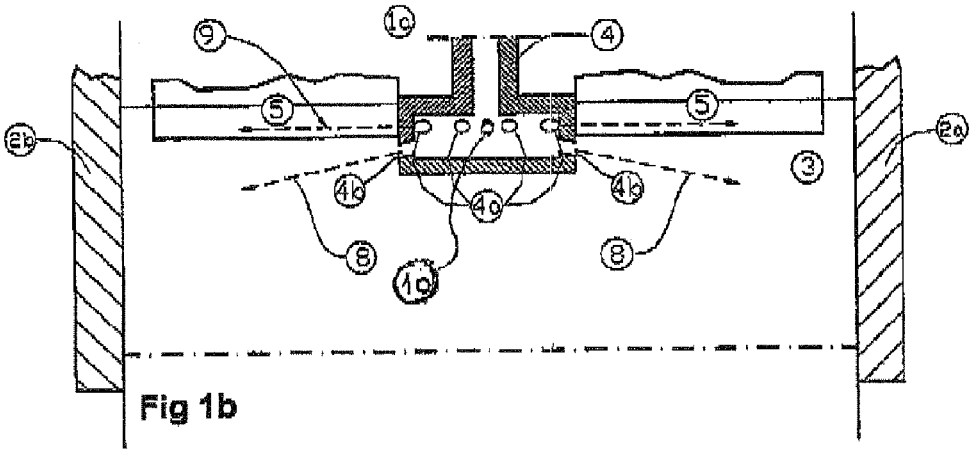

FIG. 1*b* is a schematic sectional view of the roll mould and of the apparatus subject of the present invention taken on a vertical plane parallel to the rolls' rotating axis and passing through the mould centre.

Figure 1C:
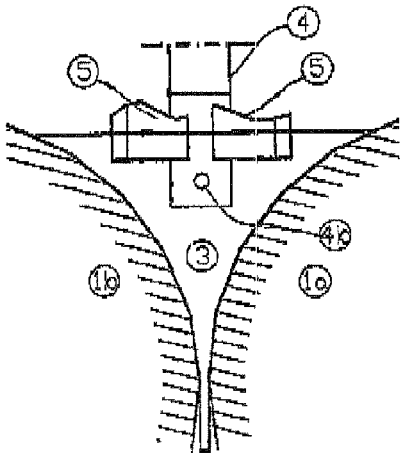

FIG. 1*c* is a schematic sectional view of the roll mould and of the apparatus subject of the present invention taken on a vertical plane orthogonal to the rolls' rotating axis and adjacent to the rolls' side surface.

DETAILED DESCRIPTION

The present invention is constituted by an apparatus, schematized in FIG. 1, for feeding molten metal into a counter-rotating roll mould for the strip direct casting. In such mould the metal is usually supplied by means of a refractory discharger (4) submersed inside the molten metal bath (3) contained into the compartment formed by the two counter-rotating rolls (1*a*, 1*b*), whereon the metal solidifies, and by two refractory plates (2*a*, 2*b*) pressed against the rolls' side surface.

The impurities, which inevitably the steel contains (generally constituted by oxides coming from the refining, the transfer or by the casting of molten metal and by particles of refractory material), tend to float up and to conglomerate on the surface of the molten metal bath causing thickenings (6) which can reach a few centimetre-squared-wide area. Such impurities (also known under the term "scum") come then in contact with the surface of the rotating rolls and they are dragged therefrom, then solidifying on the surface of the strip which is going to solidify and thus creating defects on the surface of the strip itself.

An object of the present invention is to avoid that such impurities accumulate on the surface of the molten metal bath near the surface of the casting rolls so as to obtain a cast strip with a good superficial quality wholly without cracks, depressions or cavities.

The discharging apparatus (hereinafter also designated as "plunger"), subject of the present invention, is schematized in FIG. 1 and it is constituted by a submersed refractory plunger (4) which feeds the molten metal into the mould by means of two or more pairs of holes (4*a*, 4*a*') directed symmetrically towards the surfaces of the two rolls, wherein each hole of each pair is slanted by an X angle of at least 5° with respect to the perpendicular to the rolls' axis, with direction symmetrically diverging from the centre towards the sides of the mould, (said X angle is not necessarily equal in the different pairs). These holes have a limited dipping (wherein under "dipping" the distance between the surface of the molten metal bath and the hole upper edge), generally comprised within 10 and 30 mm, and they generate a superficial flow of molten metal (9) which transports the impurities towards the mould sides. The slant towards the mould sides is fundamental to guarantee an adequate motion of the fluid and consequently of the impurities floating in such direction.

Furthermore, the plunger has at least two holes (4*b*, 4*b*'), one on each side, directed towards the side plates with the holes' axis parallel to the rolls' axis. These holes aim at addressing a molten metal flow (8) directly towards the side plates so as to avoid the formation of undesired solidifications on the plates themselves which could compromise the quality of the strip edges and which could even cause the rupture of the plates or of the strip itself.

The dipping of these holes is at least 5 mm more than the one of the holes directed towards the rolls' surface which in this solution preferably, but not necessarily, have the same dipping. The total area of these holes (4*b*, 4*b*') is preferably greater than 0.15 times and smaller than 0.3 times the total area of the other holes (4*a*, 4*a*') of the plunger directed towards the surface of the casting rolls.

Furthermore, the holes (4*b*, 4*b*') directed towards the side plates preferably, but not necessarily, are slanted downwards by an angle comprised between 5° and 30°, which depends upon the distance between the hole and the related plate.

In this way the molten metal flow (8), directed towards the plates remain at a greater depth than the superficial molten metal flow (9) which transports the impurities towards the mould sides and thus it does not hinder the motion of said impurities. Without this solution it is not possible to assure an adequate quantity of molten metal towards the plates and contemporarily an effective removal of the impurities from the area of the bath surface near the casting rolls (meniscus).

The proposed apparatus is completed with two pairs of barriers (5) positioned in the space comprised between the nozzle end and the side plates and slanted by an angle Y, between the two barriers of each pair, ranging between 5° and 30°. Such barriers can be in contact with the discharger wall and, however, they cannot be more than 10 mm away therefrom, whereas they do not come in contact either with the casting rolls (therefrom they must be preferably more than 10 mm away) and with the side plates (therefrom they have to be preferably at least 20 mm away). In case these barriers are constituted by bars made of refractory or ceramic material, they are preferably anchored to the lid (not shown in FIG. 1) which usually is utilized to protect the molten metal bath from oxidation and which are partially dipped into the molten metal for a depth preferably not lower than 5 mm.

Such barriers, positioned in this way, contribute at containing and guiding the scums' motion induced by the superficial flow of molten metal (9) parallel to the rolls' surface so as to take away such scums from the surface of the rolls themselves and convey them inside the compartment (7) formed between the nozzle and each pair of barriers.

The device subject of the present invention is effective in avoiding the formation of defects on the surface of the solidified strip, also in presence of a huge quantity of impurities wholly filling-up the compartment between the barriers and part of the space between barriers and rolls.

This thanks to the fact that the flow (8) is anyhow able to hinder the agglomeration of impurities near the roll surface.

EXAMPLE 52 tons of stainless steel AISI 304 have been cast from a ladle through a 15-t tundish into a strip mould with counter-rotating twin rolls. The steel, at a temperature of 1520° C., has been fed to the mould by means of a refractory nozzle partially dipped into the molten steel bath in the compartment formed by the two mould rolls with skirt made of nickel-plated copper with a 1500-mm diameter and 1130-mm wide, cooled inside, and sideways delimited by two containment plates made of refractory material brought near to the side wall of the rolls. A molten metal level of 420 mm has been kept into the mould and an almost 2.8-mm-thick strip has been cast at a casting speed of about 48 m/min in a total casting time of 48 minutes.

The surface of the molten steel bath has been protected by a refractory lid, supported by a steel structure, therebelow nitrogen has been blown-in to protect the bath from oxidation.

The nozzle for feeding the molten steel to the mould has been made of alumina-graphite with the shape of an upside-down T, with circular section for the vertical pipe joining the tundish, whereas the horizontal part has been implemented with a parallelepiped shape having about the following sizes: length 700 mm, width 100 mm, height 140 mm. The nozzle has been placed with the 700-mm long walls parallel to the rolls' axis and the two 100-mm wide walls parallel to the side plates.

On both long walls, faced towards the casting rolls, 35 mm away from the bottom wall, four pairs of holes have been obtained, with round section, with a 15-mm diameter and horizontal axis directed towards the rolls' surface, placed symmetrically with respect to the centre on each arm of the T of the nozzle. The holes on each nozzle arm have been placed in an equidistant way 95 mm the one from the other and they have been angled by 30° with respect to the perpendicular to the walls themselves wherein they were obtained and directed towards the short wall delimiting the end of each arm.

On each of the two short walls of the nozzle, placed at the end of each arm of the nozzle, a round hole has been obtained, with a diameter of 25 mm directed towards the opposite side plate and slanted downwards by 30°.

Under operating conditions the holes' dipping on the long sides has been 20 mm, whereas the one of the holes directed towards the side plates has been 30 mm.

Four refractory fibre barriers, $Al_2O_3$— and $SiO_2$-based, and having the sizes of 180 mm in length, 60 mm in height and 20 mm in thickness, have been anchored in the above lid so as to result in vertical position, placed with their long side towards the lid and perpendicular to the free surface of the molten metal. The barriers organized in two pairs and arranged so that the long side would form a V, have been positioned in the two regions between the narrow side of the nozzle and the opposite side plate. The two barriers constituting a pair have been placed in contact with the vertical short walls of the nozzle, they have been angled so as to form an angle of 30° therebetween and they have shown a minimum distance of 40 mm from the rolls and 36 mm from the side plates.

When the barriers have been tested, together with the nozzle described, they have been dipped for 20 mm in the molten metal and they have determined, on the bath surface, two areas for gathering the floating impurities with an almost trapezoidal shape, the confinement sides thereof were constituted by the barriers themselves (oblique sides of the trapezium), by the narrow side of the nozzle (minor base) and by the side plate itself (larger base), the latter not in contact with the barriers.

The barriers, so positioned, have contributed in containing and guiding the movement of the impurities, induced by the superficial molten metal flow parallel to the rolls' surface, so as to take away these impurities from the surface of the rolls themselves and to convey them inside the gathering area.

The continuous casting test, by utilizing the apparatus according to the present invention, has allowed the production of a strip of good quality, substantially without cracks, depressions and cavities deriving from the entrapment of impurities on the produced strip surface.

The invention claimed is:

1. A twin roll caster comprising an apparatus for confining impurities of a molten metal fed by means of a discharger and contained into an area (3) of a strip continuous casting mould delimited by the side surfaces of two counter-rotating casting rolls with horizontal axis (1*a*, 1*b*) and by two containment side plates (2*a*, 2*b*) positioned in contact with the rolls' bases, said apparatus comprising:

a discharger (4) having at least two first series of holes (4*a*, 4*a*') for the molten metal supply, each series being formed by at least a pair of holes respectively directed towards one of the opposed side surfaces of the two rolls (1*a*, 1*b*) and at least a second pair of holes (4*b*, 4*b*') for the molten metal supply, each hole of such second pair being directed towards the side plate nearest thereto, and said at least one second pair of holes (4*b*, 4*b*') being positioned at a greater depth with respect to said two first series of holes (4*a*, 4*a*'); and at least two pairs of barriers (5) present in one part of the area (3) between the end of the nozzle and the containment side plates (2*a*, 2*b*), forming a Y-shaped angle between the cross-sections of said barriers, lying on a same horizontal plane.

2. The twin roll caster comprising the apparatus for confining the impurities of a molten metal contained into a strip continuous casting mould according to claim 1, wherein the holes of said first series of holes (4*a*, 4*a*') of the discharger (4) are positioned symmetrically with respect to the nozzle centre and slanted on the horizontal plane by an X angle of at least 5° with respect to the perpendicular of the rolls' axis, so that each hole of each pair be directed in a divergent way towards the side plate nearest thereto.

3. The twin roll caster comprising the apparatus for confining the impurities of a molten metal contained into a strip continuous casting mould according to claim 2, wherein the holes of said first series of holes (4*a*, 4*a*') of the discharger (4) are slanted on the horizontal plane by an X angle optionally different for each pair of holes.

4. The twin roll caster comprising the apparatus for confining the impurities of a molten metal contained into a strip continuous casting mould according to claim 1, wherein said second pair of holes (4*b*, 4*b*') of the discharger (4) is positioned at a depth greater by at least 5 mm with respect to any of the holes of the first two series of holes (4*a*, 4*a*').

5. The twin roll caster comprising the apparatus for confining the impurities of a molten metal contained into a strip continuous casting mould according to claim 1, wherein the holes of said second pair (4*b*, 4*b*') of the discharger (4) are slanted downwards by an angle ranging between 0° and 30°.

6. The twin roll caster comprising the apparatus for confining the impurities of a molten metal contained into a strip continuous casting mould according to claim 1, wherein the holes of said first series of holes (4*a*, 4*a*') of the discharger (4) are slanted upwards by an angle ranging between 0° and 45°.

7. The twin roll caster comprising the apparatus for confining the impurities of a molten metal contained into a strip continuous casting mould according to claim 1, wherein the holes of said first series of holes (4*a*, 4*a*') of the discharger (4) have a round-shaped cross-section with a diameter ranging between 5 and 20 mm.

8. The twin roll caster comprising the apparatus for confining the impurities of a molten metal contained into a strip continuous casting mould according to claim 1, wherein the holes of said first series of holes (4*a*, 4*a*') of the discharger (4) have a cross-section with a polygonal shape.

9. The twin roll caster comprising the apparatus for confining the impurities of a molten metal contained into a strip continuous casting mould according to claim 1, wherein the holes of said first series of holes (4*a*, 4*a*') of the discharger (4) have a partially round shape and a partially polygonally-shaped cross-section.

10. The twin roll caster comprising the apparatus for confining the impurities of a molten metal contained into a strip continuous casting mould according to claim 8 or 9, wherein the polygonal holes of said first series of holes (4*a*, 4*a*') of the discharger (4) have a cross-section having a height less than 20 mm.

11. The twin roll caster comprising the apparatus for confining the impurities of a molten metal contained into a strip continuous casting mould according to claim 1, wherein the ratio between the total area of said second pair of holes (4*b*, 4*b*') and the total area of said first series of holes (4*a*, 4*a*') ranges between 0.15 and 0.30.

12. The twin roll caster comprising the apparatus for confining the impurities of a molten metal contained into a strip continuous casting mould according to claim 1, wherein said discharger (4) has, in the centre, at least an additional hole directed perpendicularly to the side surface of the rolls, positioned between said first series of holes (4*a*, 4*a*') of the discharger (4).

13. The twin roll caster comprising the apparatus for confining the impurities of a molten metal contained into a strip continuous casting mould according to claim 1, wherein said Y angle ranges between 5° and 45°.

14. The twin roll caster comprising the apparatus for confining the impurities of a molten metal contained into a strip continuous casting mould according to claim 1, wherein each of said barriers (5) is constituted by one or more parts of refractory or ceramic material containing compounds selected from the group comprising $Al_2O_3$, BN, $ZrO_2$, SiC, SiN, $SiO_2$, MgO and combinations thereof.

15. The twin roll caster comprising the apparatus for confining the impurities of a molten metal contained into a strip continuous casting mould according to claim 1, wherein said barriers (5) are slanted with respect to the vertical.

16. The twin roll caster comprising the apparatus for confining the impurities of a molten metal contained into a strip continuous casting mould according to any claim 1, wherein said barriers (5) are fastened to a lid positioned in the mould above the molten metal bath or said barriers (5) are an integral part of the lid itself.

17. The twin roll caster comprising the apparatus for confining the impurities of a molten metal contained into a strip continuous casting mould according to claim 1, wherein said barriers (5) are fastened to said discharger (4) or they belong to the discharger itself.

18. The twin roll caster comprising the apparatus or confining the impurities of a molten metal contained into a strip continuous casting mould according to claim 1, wherein said barriers (5) are formed by jets of inert or reducing gas directed from a top towards a surface of the molten metal.

19. The twin roll caster comprising the apparatus for confining the impurities of a molten metal contained into a strip continuous casting mould according to claim 18, wherein said gas, before being blown on the molten metal surface, is preheated at a temperature greater than 100° C.

20. Use of the twin roll caster comprising the apparatus for confining the impurities of a molten metal contained into a strip continuous casting mould according to claim 1, wherein during use, said barriers (5) are positioned at least 10 mm away from the side surface of the rolls, at least 20 mm away from the side plates (2*a*, 2*b*) and not less than 10 mm away from the discharger.

21. Use of the twin roll caster comprising the apparatus for confining the impurities of a molten metal contained into a strip continuous casting mould according to claim 1, wherein during use said barriers (5) are partially dipped into the molten metal for at least 5 mm.

* * * * *